US007625244B2

(12) United States Patent
Midorikawa

(10) Patent No.: US 7,625,244 B2
(45) Date of Patent: Dec. 1, 2009

(54) MALE CONNECTOR HAVING SOLDER BARRIER LAYER AND CONNECTOR ASSEMBLY

(75) Inventor: Kazuya Midorikawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/155,520

(22) Filed: Jun. 5, 2008

(65) Prior Publication Data

US 2008/0305657 A1 Dec. 11, 2008

(30) Foreign Application Priority Data

Jun. 6, 2007 (JP) ..... 2007-150054

(51) Int. Cl.
*H01R 24/00* (2006.01)
*H01R 33/00* (2006.01)

(52) U.S. Cl. ..... 439/660; 439/66

(58) Field of Classification Search ..... 439/660, 439/66, 74

See application file for complete search history.

(56) References Cited

U.S. PATENT DOCUMENTS 5,975,916 A * 11/1999 Okura ..... 439/74
6,623,308 B2 * 9/2003 Ono ..... 439/680
6,881,075 B2 * 4/2005 Huang et al. ..... 439/74
7,195,495 B2 * 3/2007 Takano et al. ..... 439/74

FOREIGN PATENT DOCUMENTS

JP 2055703 U 10/1998

OTHER PUBLICATIONS

European Search Report, Aug. 18, 2008.

* cited by examiner

*Primary Examiner*—Javaid Nasri
(74) *Attorney, Agent, or Firm*—Kubotera & Associates, LLC

(57) ABSTRACT

A male connector is attached to a circuit board and fits with a female connector in a fitting direction perpendicular to a surface of the circuit board. A terminal of the male connector extends outside a housing thereof in parallel to the circuit board. The terminal has a connection portion to be connected with a circuit portion of the circuit board with solder. When the male connector and the female connector are fitted with each other, the connection portion has a facing region facing a top face of a peripheral wall of a housing of the female connector. The terminal includes a solder barrier layer formed at least in a nearest facing region of the facing region. The nearest facing region is situated to be closest to the top face.

11 Claims, 8 Drawing Sheets

MALE CONNECTOR HAVING SOLDER BARRIER LAYER AND CONNECTOR ASSEMBLY

BACKGROUND OF THE INVENTION AND RELATED ART STATEMENT

The present invention relates to a male electrical connector to be attached to a circuit board (hereinafter called "male connector") and an electrical connector assembly for a circuit board (hereinafter called "connector assembly") having the male electrical connector and a female electrical connector (hereinafter called "female connector") to be attached to another circuit board.

Publication Reference has disclosed a connector assembly for a circuit board. According to Publication Reference, each of a male connector and a female connector is attached to a circuit board. Further, the male connector and the female connector are fitted with each other to connect in a direction perpendicular to a surface of the circuit board. Accordingly, when the male connector and the female connector are fitted, the circuit boards become parallel to each other. A terminal of the male connector forms a connection portion in a portion that extends outside a housing thereof along a surface of the circuit board. Further, the connection portion is connected to a corresponding circuit portion of the circuit board with solder.

Publication Reference: Japanese Utility Model Publication No. 3055703

In the female connector, a peripheral wall of a housing is situated outside with respect to a fitting portion of the male connector. Further, a top face of the peripheral wall faces a connection portion of the male connector. The top face of the peripheral wall is adjacent to and faces the connection portion of a terminal of the male connector.

The terminal of the male connector is connected with the circuit portion of the circuit board with solder in the connection portion. Molten solder rises from a solder connection surface of the connection portion due to surface tension. Further, the molten solder may reach a surface other than the solder connection surface that is tangent to the circuit portion. That is, a phenomenon called a "solder rising" occurs.

The molten solder rises to a side edge surface of the connection portion due to the solder rising; thereby forming a fillet shape portion between a side edge surface and a surface of the circuit portion, thereby improving strength of the solder connection.

The solder rising does not stop at the side edge surface of the connection portion. Instead, the solder rising proceeds further to reach a facing region in which the solder connection surface faces an opposite side surface of the solder connection surface, or a top face of a peripheral wall of the female connector (mating connector).

Further, a swelling in the facing region of the connection portion may be formed there. The solder connection of the connection surface can be visually confirmed due to the solder rising. On the other hand, the connection portion may collide with the top face of the housing peripheral wall of the female connector due to the solder swelling in the facing region of the connection portion, thereby making it difficult to fit the male connector and the female connector.

To this end, in Publication Reference, a space is formed as an escape portion, so that it is easy to fit the male connector and the female connector even when the male connector has the solder swelling in the connection portion. The escape portion is recessed from the top face of the housing peripheral wall of the female connector.

According to Publication Reference, the escape portion of the female connector can prevent a trouble caused by the solder swelling in the connection portion of the terminal of the male connector. It should be noted, however, that it is necessary to provide the escape portion with a depth sufficiently larger than an expected amount of the solder swelling to certainly prevent the trouble. When a size of the escape portion increases, a size of the female connector increases as well in a fitting direction unless a special attention is paid to a size and an arrangement of the terminal.

As described above, the solder swelling caused by the solder rising can inhibit a complete fitting of the male connector and the female connector. Further, when an automatic quantitative soldering is conducted, an amount of the solder may become insufficient in the solder connection portion by an amount corresponding to the solder rises, thereby decreasing the connection strength. Accordingly, the escape portion of the female connector may prevent the problem in the first case, but does not in the latter case.

In view of the problems described above, an object of the present invention is to provide a male connector for a circuit board and a connector assembly comprising the male connector and a female connector for a circuit board. In the present invention, it is possible to prevent the male connector from insufficiently fitting to the female connector, and to provide solder with a sufficient amount in a solder connection portion. Further, it is possible to minimize a solder rising and maintain strength of a fillet shape portion.

Further objects of the invention will be apparent from the following description of the invention.

SUMMARY OF THE INVENTION

In order to attain the objects described above, according to the present invention, a male connector is attached to a circuit board and fits with a female connector in a fitting direction perpendicular to a surface of the circuit board. A terminal of the male connector extends outside a housing thereof in parallel to the surface of the circuit board. The terminal has a connection portion that is connected with a circuit portion of the circuit board with solder. When the male connector and the female connector are fitted with each other, the connection portion has a facing region which faces a top face of a peripheral wall of a housing of the female connector in the fitting direction.

According to the present invention, the terminal includes a solder barrier layer formed at least in a nearest facing region of the facing region of the connection portion of the terminal. The nearest facing region is situated to be closest to the top face of the peripheral wall in the fitting direction.

In the present invention, the solder barrier layer is a surface layer of the terminal that is provided as a region in which molten solder has poor solderability property with respect to the terminal.

In general, the terminal is plated with nickel as a base layer. The nickel plated layer has poor solderability property and is not suitable as the solder connection portion of the terminal. Accordingly, the terminal is often plated with copper or gold on a top of the nickel plate. The copper or gold plated surface has good solderability property.

In this case, for example, a partial region that is not plated with copper or gold may be provided. A surface layer of such a region becomes a layer plated with nickel, which can be a solder barrier layer.

In the present invention, a material forming the solder barrier layer or a method of forming the solder barrier layer is not limited, and may be operable by any publicly known method. For example, a surface layer may be formed of an oxide layer, a resist ink, and the like as the solder barrier layer. It is sufficient that a material having poorer solderability than that of a portion to be connected to the terminal with solder is provided as the solder barrier layer in the nearest facing region.

In the present invention, the solder barrier layer is formed at least in the nearest facing region of the facing region in which the connection portion of the terminal of the male connector faces the female connector. Accordingly, a solder swelling due to solder rising does not occur in the nearest facing region.

Accordingly, it is easy to fit the male connector to the female connector to a specific depth. Further, an influence of a solder shortage in the solder connection surface is minimized. At the same time, the solder barrier layer is not provided on a side edge surface of the connection portion, thereby allowing the solder rising. Accordingly, the solder connection strength is sufficiently obtained in the fillet shape portion.

According to the present invention, it is preferred that the solder barrier layer in the nearest facing region extends from a portion on a base portion side toward a peripheral surface of the terminal in a band shape in an extending direction of the connection portion. The solder barrier layer having a band shape revolves around the peripheral surface.

Accordingly, the solder barrier layer prevents solder from traveling from the connection portion of the terminal to the base portion side at any position in a circular direction of the terminal. Further, the solder barrier layer having a band shape is situated on the base portion side in the extending direction. Accordingly, almost an entire range in the connection portion has good solderability, thereby ensuring solder strength.

According to the present invention, it is preferred that the nearest facing region be formed on the base portion side in the extending direction of the connection portion. Accordingly, the solder swelling is prevented in an inner range in the connection portion extending direction more than in a portion in which the nearest facing region is provided, thereby ensuring a sufficient fitting depth of the male connector in the range.

In this case, a facing direction distance with the female connector outside the range is longer than that of the range. Accordingly, the fitting of the male connector is not inhibited even when the solder swelling occurs outside the range. Further, the solder connection portion has a sufficient amount of solder and connection strength is improved due to the solder rising. Further, solder can be visually confirmed.

According to the present invention, a connector assembly comprises the male connector and the female connector. The male connector and the female connector are attached to the respective circuit boards and fitted with each other in the fitting direction perpendicular to the surfaces of the circuit boards.

Further, the connector assembly includes at least the connection portion and the facing region. In the connection portion, the terminal of the male connector extends outwardly from the housing thereof in parallel to the surface of the circuit board. Further, the connection portion is connected to the circuit portion of the circuit board with solder. In the facing region, the connection portion of the terminal of the male connector faces the top face of the peripheral wall of the housing of the female connector in the fitting direction when the male connector and the female connector are fitted with each other.

According to the present invention, the connector assembly includes the solder barrier layer d at least in the nearest facing region in which the connection portion of the terminal of the male connector is situated nearest to the peripheral wall top face in the fitting direction of the facing region.

As described above, the solder barrier layer is provided in the nearest facing region in the connection portion of the terminal of the male connector. Accordingly, there is no solder swelling in the region. Further, the fitting of the connector assembly is ensured up to a specific depth. Accordingly, the connectors are connected with each other securely. Further, a height of the connector assembly in the fitting direction does not have to be excessively large in consideration of the solder swelling, thereby reducing a size of the connector assembly in the direction.

According to the present invention, the peripheral wall top face of the housing of the female connector may be formed so that a portion that corresponds to the facing region of the connection portion of the terminal of the male connector comprises an adjacent portion that corresponds to the nearest facing region and a residual portion. The residual portion is recessed from the adjacent portion in the fitting direction.

In this case, the connection portion of the terminal of the male connector is provided with the solder barrier layer in the nearest facing region and there is no solder swelling there. Accordingly, the male connector and the female connector are fitted with each other up to a specific depth without any obstructions. The solder barrier layer is not necessarily provided in a region other than the nearest facing region. Accordingly, there can be the solder swelling. When the residual portion is recessed from the adjacent portion in the female connector, it is easy to deal with the solder swelling.

According to the present invention, it is preferred that the terminal of the male connector be formed of a metal band body bending in a plate thickness direction thereof. Further, it is preferred that a terminal of the female connector be formed of a metal sheet maintaining a flat plate surface thereof.

In the configuration described above, the plate thickness direction of the connection portion of the terminal of the male connector is aligned with the fitting direction of the male connector, and the plate surface becomes the solder connection surface. Accordingly, an area of the solder connection surface is enlarged, thereby increasing the solder connection strength and reducing a size of the connector assembly in the fitting direction due to the solder barrier layer.

As described above, according to the present invention, the solder barrier layer is provided in the nearest facing region of the facing region that faces the female connector in the connection portion of the terminal of the male connector. The male connector is connected to the circuit board with solder. Further, the facing region that faces the female connector is situated on the opposite side of the solder connection surface.

Accordingly, it is possible to prevent the solder rising to the nearest facing region, and no solder swelling occurs in the region. Accordingly, the male connector can be very close to or adjacent to the housing peripheral wall of the female connector in the region, thereby making it easy to fit the male connector to the female connector.

Further, the connectors can be low-profiled. Further, there is no solder rising; thereby preventing the solder connection strength from being deteriorated without causing a shortage of solder in the solder connection portion. In addition, the solder rising occurs from the solder connection surface on the side edge surface of the connection portion in which the solder barrier layer is not provided. Accordingly, the fillet shape portion is provided there, thereby ensuring the solder connection strength.

BRIEF DESCRIPTION OF THE DRAWINGS

FIGS. 3(A) and 3(B) are sectional views showing the male connector and the female connector taken along a line passing through terminals thereof, wherein FIG. 3(A) is a sectional view showing the male connector and the female connector before the male connector is fitted into the female connector, and FIG. 3(B) is a sectional view showing the male connector and the female connector after the male connector is fitted into the female connector;

FIGS. 8(A) and 8(B) are sectional views showing a male connector and a female connector according to another embodiment of the present invention, wherein FIG. 8(A) is a sectional view showing the male connector and the female connector before the male connector is fitted into the female connector, and FIG. 8(B) is a sectional view showing the male connector and the female connector after the male connector is fitted into the female connector.

DETAILED DESCRIPTION OF THE PREFERRED EMBODIMENTS

Hereunder, embodiments of the present invention will be explained with reference to the accompanying drawings.

In the embodiment, a connector assembly comprises a male connector and a female connector. The male connector and the female connector are fitted with each other to be connected. Each of the male connector and the female connector is attached to a circuit board, so that surfaces of the circuit boards are parallel to each other. Further, the male connector and the female connector are fitted with each other in a direction perpendicular to the surfaces of the circuit boards.

In the embodiment, the male connector has a housing portion having a protruding shape, while the female connector has a housing portion having a recess shape. A contact portion of a terminal that is attached to the housing is situated in the housing portion. The male connector and the female connector are fitted with each other at the protruding portion and the recess portion described above, so that the contact potions contact with each other. Accordingly, the male connector and the female connector are electrically connected.

Figure 1:
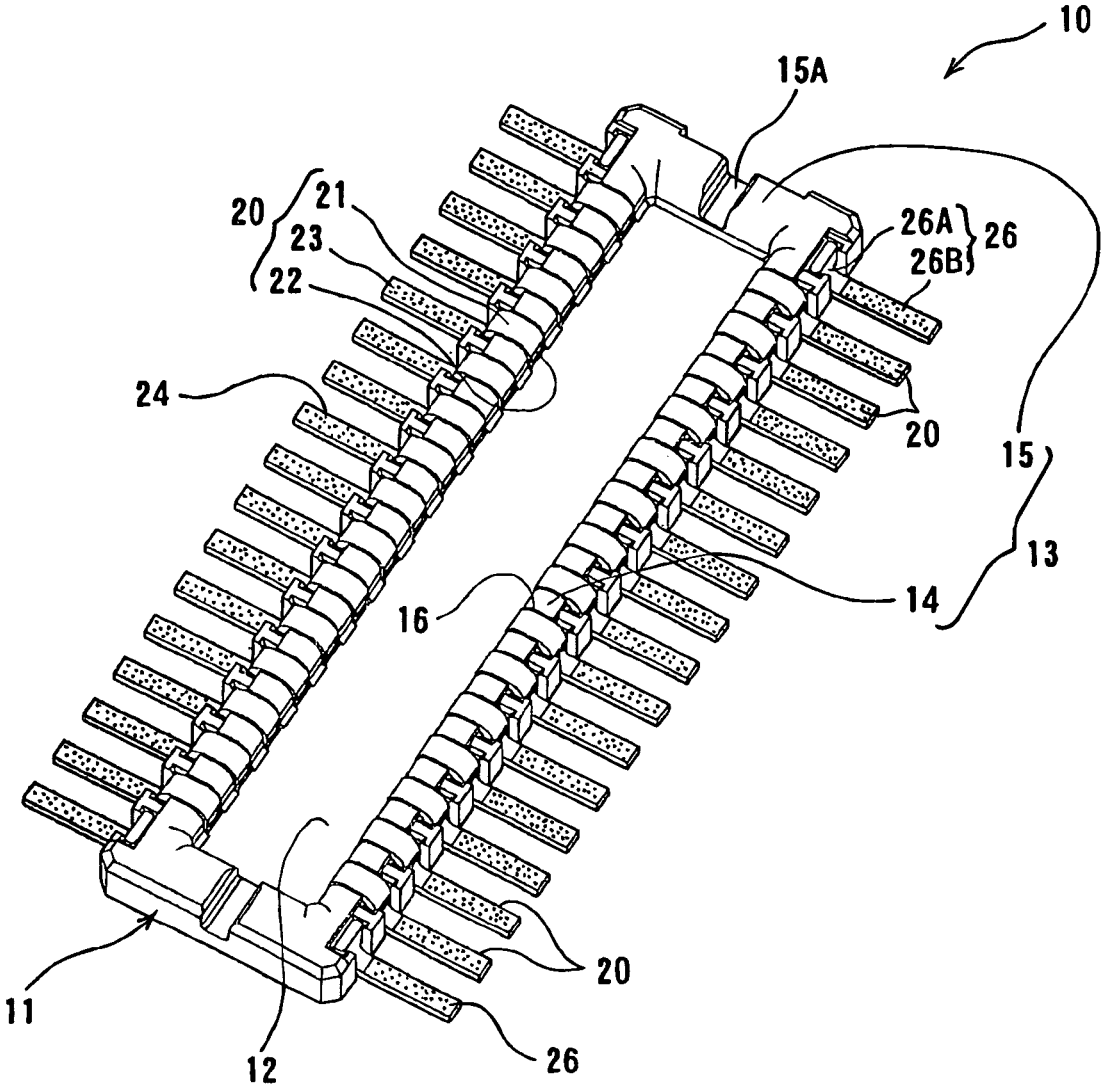
FIG. 1 is a perspective view showing a male connector according to an embodiment of the present invention.

FIG. 1 is a perspective view showing a male connector 10 according to an embodiment of the present invention. In FIG. 1, a circuit board to which the male connector 10 is attached is not shown. A recess portion 12 is formed in a center portion of a housing 11 of the male connector 10. The housing 11 is flat and has a planar shape of approximate rectangle. Further, a peripheral wall 13 that protrudes from the housing 11 is provided in the male connector 10. The peripheral wall 13 comprises two sidewalls 14 in a longitudinal direction of the housing 11 and edge walls 15 that connect the sidewalls 14 on the both edges of the longitudinal direction.

A plurality of a terminal 20 is arranged and held at specific intervals in the longitudinal direction of the sidewall 14. A metal fixture 26 is attached to be adjacent to the terminal 20 that is arranged on each edge of the rows of the plurality of the terminal 20. The terminal 20 and the metal fixture 26 will be explained below.

Dent portions 15A are formed in center positions of the edge walls 15 of the housing 11. The dent portion 15 pierces the edge wall 15 in the longitudinal direction in which the sidewalls 14 extend. Further, the dent portion 15 opens upward.

The male connector 10 connects the dent portions 15A of the edge walls 15 that face each other. Further, the male connector 10 is symmetrical with respect to an axis line that extends in the longitudinal direction. Further, the male connector 10 is symmetrical with respect to a centerline that is perpendicular to the axis line in a center of the longitudinal direction thereof.

As shown in FIG. 1, the male connector 10 is attached to a circuit board P1. The terminal 20 of the male connector 10 is made through bending and forming a metal member having a band shape in a plate thickness direction thereof. Further, the terminals 20 are arranged and held at specific intervals in the sidewalls 14 of the housing 11.

Figure 3:
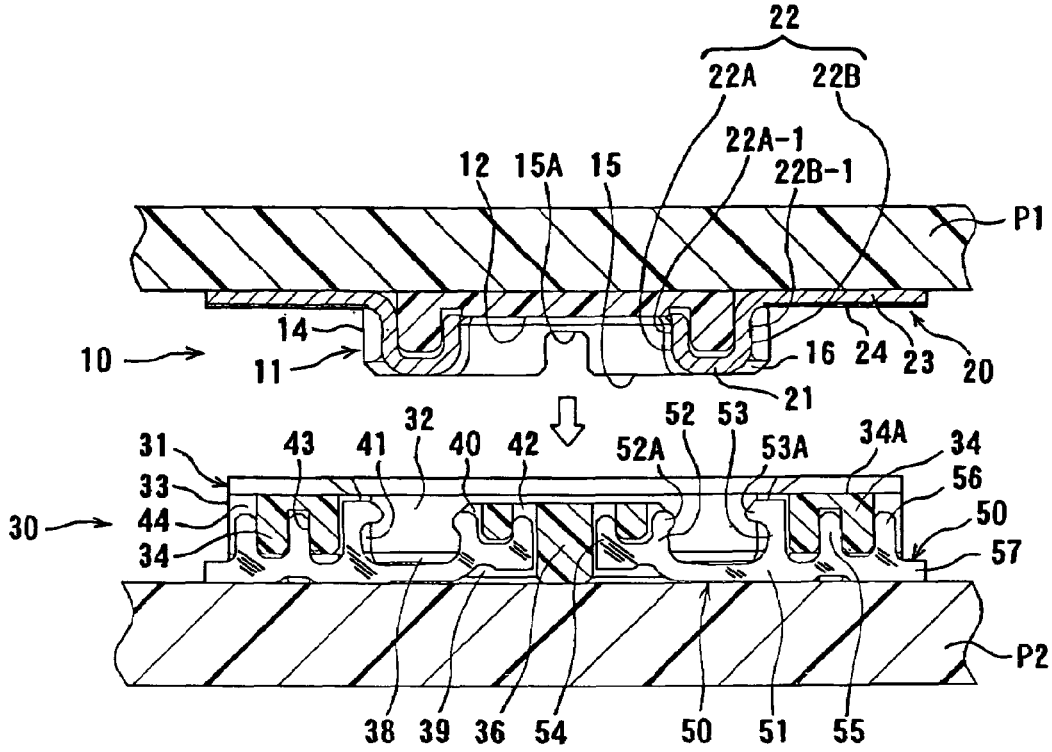
Figure 3:
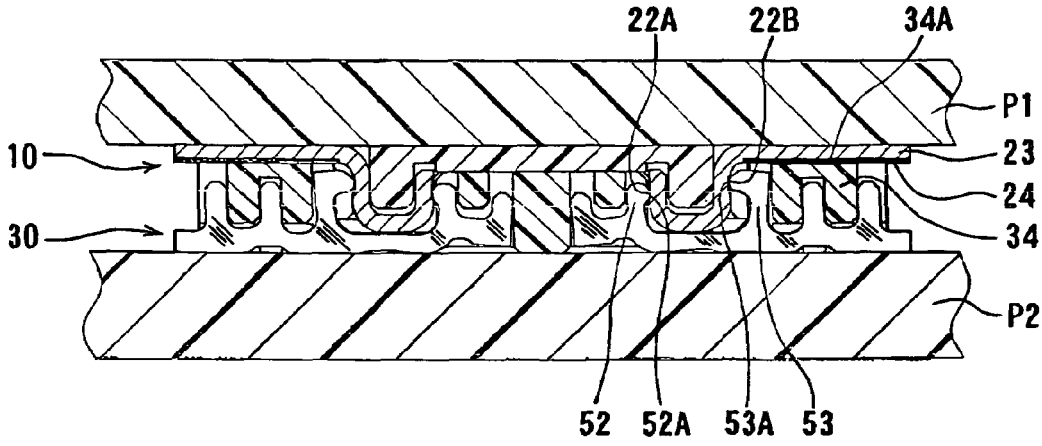

FIGS. 3(A) and 3(B) are sectional views showing the male connector 10 and the female connector 30 taken along a line that passes through the terminals. More specifically, FIG. 3(A) is a sectional view showing the male connector 10 and the female connector 30 before the male connector 10 is fitted into the female connector 30. FIG. 3(B) is a sectional view showing the male connector 10 and the female connector 30 after the male connector 10 is fitted into the female connector 30.

The male connector 10 shown in FIGS. 3(A) and 3(B) faces with respect to the female connector 30, a mating connector in a fitting direction. That is, the male connector 10 is vertically flipped from that shown in FIG. 1.

The terminal 20 comprises an attached portion 21, a contact portion 22, and a connection portion 23. The attached portion 21 is formed to fit into a terminal holding groove 16 from the top face of the sidewall 14 of the housing 11 (a top face in FIG. 1, a lower surface in FIG. 3(A)).

The terminal holding groove 16 is formed to extend to the inner and outer wall surfaces of the sidewall 14. The contact portion 22 is formed in the inner and outer surfaces of the attached portion 21. The connection portion 23 is bent in an L-character shape outside of the sidewall 14 and extends along a surface of the circuit board P1. The contact portion 22 comprises a first contact portion 22A and a second contact portion 22B.

In the embodiment, the first contact portion 22A is formed inside of the sidewall 14, or the inner surface that faces the recess portion 12. Further, the second contact portion 22B is situated outside of the sidewall 14. Locking portions 22A-1 and 22B-1 are provided in the first contact portion 22A and the second contact portion 22B, respectively, in order to maintain a stable contact position with a corresponding contact portion of the terminal of the female connector, or the mating connector. The locking portions 22A-1 and 22B-1 are slightly recessed.

When the male connector 10 is fitted into the female connector 30, the connection portion 23 has a region that faces the housing of the female connector 30 on the opposite surface of the surface that is tangent to the circuit board P1.

The female connector 30 will be explained below. In the embodiment, the region is called a "facing region". In the embodiment, a surface of the facing region is a surface layer 24, which has poorer solderability than that of surfaces of the other portions. The surface layer with poor solderability is called a solder barrier layer 24.

A corresponding portion of the housing of the female connector that the facing region faces in the embodiment can form a surface having a step shape. In the embodiment, a portion of the facing region that is nearest to the corresponding portion is called the nearest facing region. Similarly, when the connection portion forms a surface having a step shape, the region in which the facing surfaces are nearest to each other is called the nearest facing region.

In the embodiment, the terminal 20 is nickel plated as an under layer. Further, the terminal 20 is copper plated or gold plated. The copper plate and the gold plate have good conduction and solderability, while the nickel plate has poor solderability.

In the embodiment, the nickel plate as an under layer is exposed to form the solder barrier layer 24 while preventing a necessary portion of the facing region from being copper plated or gold plated.

Figure 4:
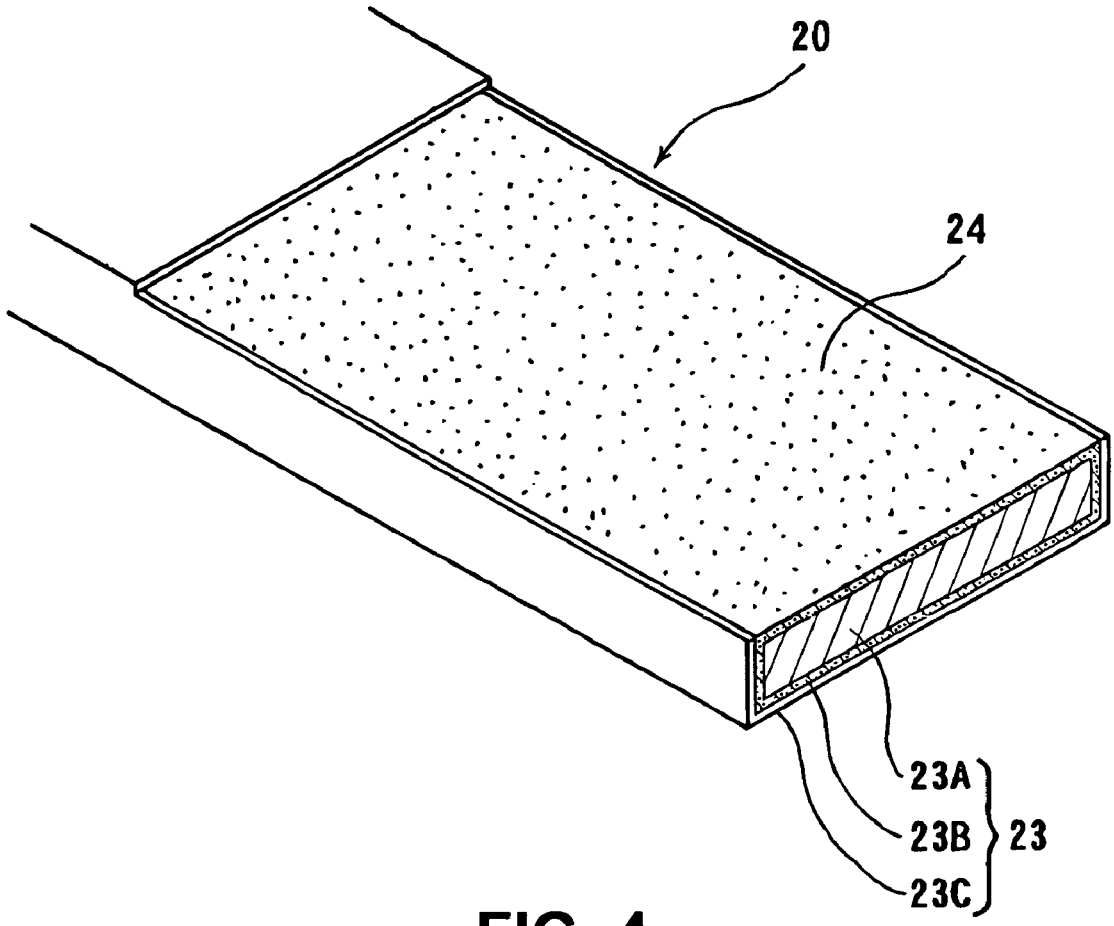
FIG. 4 is an enlarged perspective view showing a connection portion of the male connector according to the embodiment of the present invention.

FIG. 4 is an enlarged perspective view showing the connection portion 23 of the male connector 10 according to the embodiment of the present invention. As shown in FIG. 4, a whole surface of a material 23A of the connection portion 23 is plated with a nickel plate 23B as an under layer. The material 23A has a flat band shape. Further, the whole surface of the material 23A of the connection portion 23 except the facing region is further plated with a gold plate 23C.

A required portion of the facing region is masked after plated with the nickel plate 23B as an under layer. Further, the terminal is gold plated. When the masking is removed, the nickel plate 23B forms the solder barrier layer 24 in the required portion of the facing region.

Figure 5:
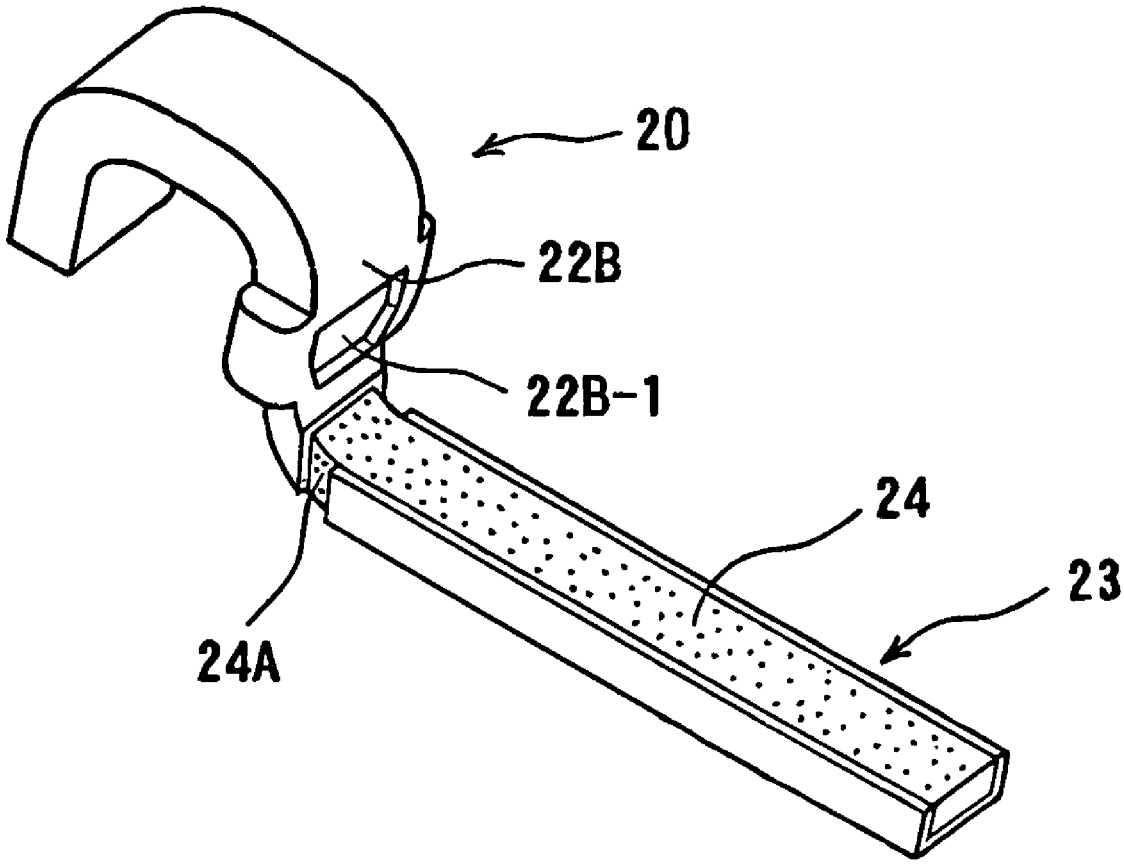
FIG. 5 is an enlarged perspective view showing a modified example of the connection portion of the male connector according to the embodiment of the present invention.

FIG. 5 is an enlarged perspective view showing a modified example of the connection portion 23 of the male connector 10 according to the embodiment of the present invention. As shown in FIG. 5, the solder barrier layer 24 of FIG. 4 further have a revolving solder barrier layer 24A. The revolving solder barrier layer 24A extends in a band shape on a surrounding surface of the connection portion 23.

In the embodiment, each of the metal fixtures 26 is attached to the sidewall 14, along with the terminals 20, on the outer positions with respect to an arrangement range of a set of the terminals 20 that is arranged and held on the sidewalls 14 of the housing 11. The metal fixture 26 is manufactured in a similar way with the terminal 20 except that the metal fixture 26 does not have a contact portion.

The metal fixture 26 comprises an attached portion 26A and a fixed portion 26B. The attached portion 26A is bent in the plate thickness direction thereof to form an L-character shape. Further, the attached portion 26A is attached to and held by a holding groove that is formed on an outer surface of the sidewall 14 of the housing 11. The fixed portion 26B extends in parallel and along with the connection portion 23 of the terminal 20.

Similar to the connection portion 23 of the terminal 20, the fixed portion 26B is connected to the circuit board P1 with solder on the surface that faces the circuit board P1. The surface of the opposite side is the facing region that faces the female connector. Accordingly, similar to the case of the terminal 20, the facing region is provided with a solder barrier layer.

Figure 2:
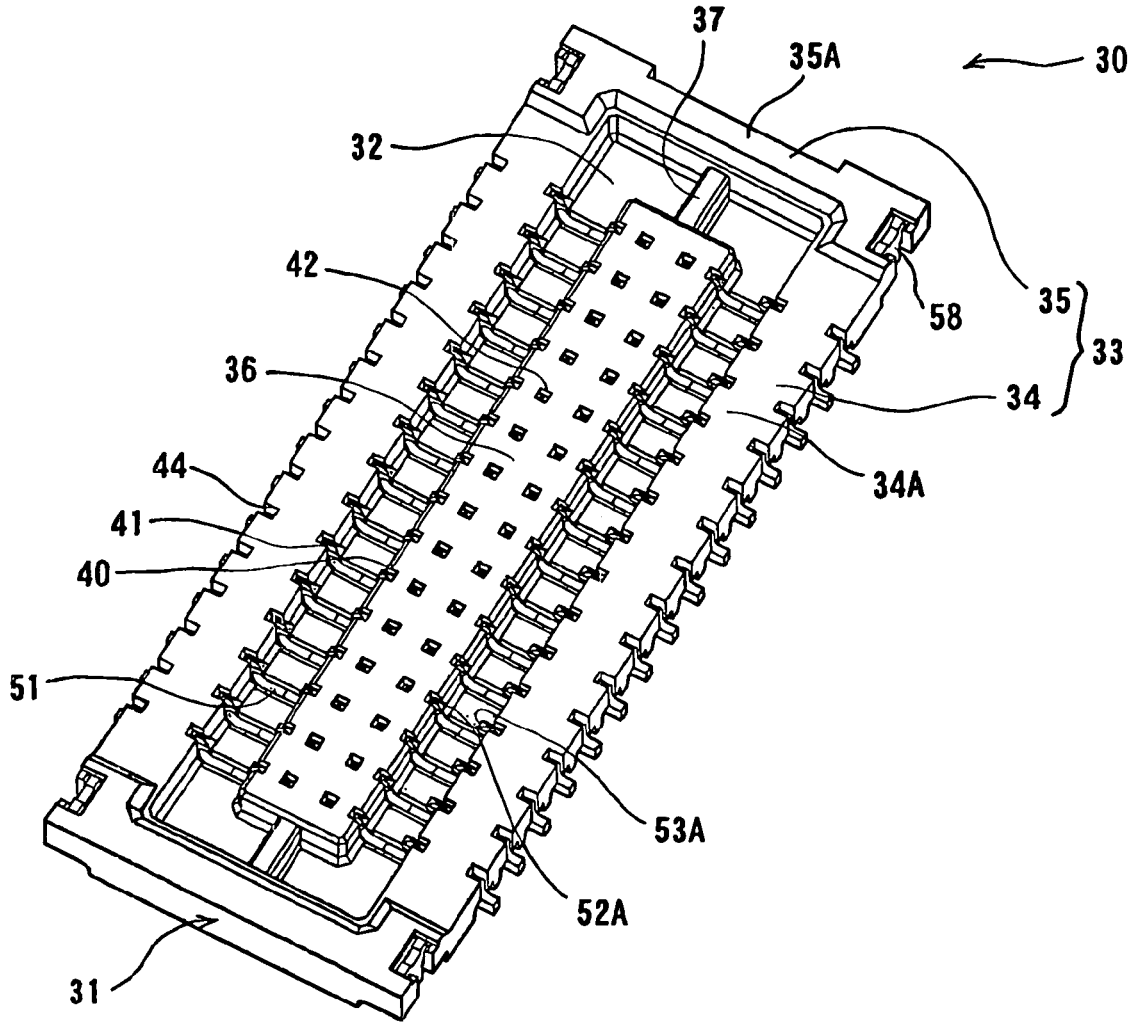
FIG. 2 is a perspective view showing a female connector according to the embodiment of the present invention.

In the embodiment, the female connector 30 that receives the male connector 10 has an appearance as shown in FIG. 2 and a section as shown in FIG. 3(A).

As shown in FIG. 2, the female connector 30 is attached to a circuit board P2 (not shown in FIG. 2) when used. Further, terminals 50 and a metal fixture 58 are attached to a housing 31.

The housing 31 is provided with a receiving recess portion 32 inside of a peripheral wall 33. The peripheral wall 33 comprises two sidewalls 34 and edge walls 35. The sidewall 34 extends in a longitudinal direction. The longitudinal direction is a terminal arrangement direction. The edge wall 35 is provided on each end of the longitudinal direction. Further, the housing 31 has a protruding portion 36 having an island shape.

The protruding portion 36 is surrounded by the receiving recess portion 32. The connecting portions 37 connect the protruding portion 36 to the edge walls 35 to reinforce on both ends of the longitudinal direction. The receiving recess portion 32 receives the peripheral wall 13 of the male connector 10. Further, the protruding portion 36 fits into the recess portion 12 of the male connector 10.

At that time, the connecting portion 37 enters into the dent portion 15A of the male connector 10. Further, a top face 34A of the sidewall 34 is recessed in a step shape with respect to a top face 35A of the edge wall 35. When the male connector 10 and the female connector 30 are fitted with each other, the facing region of the connection portion 23 of the terminal 20 of the male connector 10 is substantially tangent to the top face 34A of the sidewall 34 of the female connector 30.

The terminal 50 of the female connector 30 has an outer shape in which a metal sheet is processed while maintaining the planarity of the metal sheet. As shown in FIG. 3(A), the terminal 50 of the female connector 30 is held by the housing 31 at a position that corresponds to the terminal 20 of the male connector 10 in the longitudinal direction.

As shown in FIG. 3(A), the terminal 50 comprises a base portion 51, a first contact arm 52, a second contact arm 53, a first attached arm 54, a second attached arm 55, a third attached arm 56, and a connection portion 57.

The base portion 51 is positioned in a lower surface of the housing 31 and extends to be parallel to the lower surface. The first contact arm 52 and the second contact arm 53 extend upward from the base portion 51 in a middle portion of a direction in which the base portion 51 extends. The first attached arm 54, the second attached arm 55, and the third attached arm 56 extend upward from the base portion 51 on both sides with respect to the first contact arm 52 and the second contact arm 53, respectively. Further, the base portion 51 extends outside of the housing to form the connection portion 57. Further, a first contact portion 52A and a second contact portion 53A are formed in the first contact arm 52 and the second contact arm 53, respectively.

The first contact portion 52A and the second contact portion 53A face each other and protrude on the top edges thereof. The first attached arm 54 is situated on a backside of the first contact arm 52. Further, the first attached arm 54 is positioned in a center side of the connector.

The second attached arm 55 and the third attached arm 56 are situated on a back of the second contact arm 53. Further, the second attached arm 55 and the third attached arm 56 are positioned near an outer side of the connector. The first contact arm 52 and the second contact arm 53 have an elasticity to bend in a direction in which the first contact portion 52A and the second contact portion 53A are away from each other, respectively. The first contact arm 52 and the second contact arm 53 are bent when a contact pressure is received from the terminal 20 of the male connector 10, the mating connector, in the first contact portion 52A and the second contact portion 53A, respectively.

In the embodiment, metal fixtures 58 are attached to corresponding grooves of the housing 31 outside of arrangement ranges of the terminals 50. The metal fixture 58 has a plate shape. Further, a lower edge of the metal fixture is exposed from a bottom surface of the connector to be fixed to the circuit board with solder.

Terminal holding grooves 38 are formed in the housing 31 to correspond to a shape of the terminals 50. The terminal holding groove 38 is situated in a position that corresponds to each terminal 20 of the male connector 10 in a longitudinal direction of the housing 31 and holds the terminal 50 there. As shown in FIG. 3(A), a bottom groove 39 covers a range from the protruding portion 36 to the sidewall 34 in the terminal holding groove 38 in the lower surface of the housing 31. Further, branched grooves of a variety extend upward.

As shown in FIG. 3(A), an inner holding groove 40 and an outer holding groove 41 are formed to open toward the receiving recess portion 32 on an inner surface of the wall portion of the receiving recess portion 32. The inner holding groove 40 and the outer holding groove 41 face each other and extend upward from the bottom groove 39 of terminal holding groove 38.

A first holding groove 42, a second holding groove 43, and a third holding groove 44 are provided on the opposite side of the receiving recess portion 32 with respect to the inner holding groove 40. The first holding groove 42 extends inside of the protruding portion 36 having an island shape and passes through upward. The second holding groove 43 extends inside of the sidewall 34. The third holding groove 44 is provided on an outer surface of the sidewall 34.

The first contact arm 52 and the second contact arm 53 of the terminal 50 are stored in the inner holding groove 40 and the outer holding groove 41 of the terminal holding groove 38, respectively. The first attached arm 54 is stored in the first holding groove 42. Further, the second attached arm 55 and the third attached arm 56 are stored in the second holding groove 43 and the third holding groove 44, respectively.

The first attached arm 54 is loosely fitted into the first holding groove 42. The second attached arm 55 is pressed to fit into the second holding groove 43. The third attached arm 56 is pressed by a bottom surface of the third holding groove 44. Accordingly, the terminal 50 is held.

The male connector 10 and the female connector 30 of the embodiment are constituted as described. The male connector 10 and the female connector 30 are used as described below.

First, the male connector 10 and the female connector 30 are attached to the circuit boards P1 and P2, respectively. That is, the male connector 10 and the female connector 30 are connected to the respective corresponding circuit portion in the connection portion 23 of the terminal 20 and the connection portion 57 of the terminal 50, respectively, with solder. Further, the metal fixture 26 of the male connector 10 and the metal fixture 58 of the female connector 30 are fixed to the respective corresponding portion of the circuit board with solder.

When the terminal 20 of the male connector 10 is connected with the corresponding circuit portion of the circuit board P1 in the connection portion 23 with solder, molten solder connects the male connector 10 and the circuit board P1 in the tangent area of the connection portion 23 and the corresponding circuit portion with solder. Further, the molten solder reaches the side faces of the connection portion 23 in which a fillet portion is formed. Accordingly, a contact area between the connection portion 23 and the corresponding circuit portion is increased; and thereby improving the electrical property and strengthening a retention force in the circuit board of the connector.

The molten solder can further rise from the side faces of the connection portion 23 to a free surface on the opposite side of the tangent area; that is, the facing region. Further, the molten solder can rise from the free surface to the base portion of the connection portion 23. In the embodiment, however, as shown in FIGS. 1, 3(A), and 4, the solder barrier layer 24 is provided in the facing region that is the free surface of the connection portion 23. Accordingly, even if the molten solder rises from the side faces of the connection portion 23, the molten solder does not reach the facing region. Accordingly, the solder does not adhere to the facing region or is not swollen due to an adhesion. Similarly, the solder is not swollen in the fixed portion 26B of the metal fixture 26 of the male connector.

As shown in FIG. 5, when the revolving solder barrier layer 24A is provided, the molten solder does not proceed toward the housing side of the revolving solder barrier layer 24A.

Accordingly, as shown in FIG. 3(B), the male connector 10 that is attached to the circuit board P1 and the female connector 30 that is attached to the circuit board P2 are fitted with each other in a direction perpendicular to the surfaces of the circuit boards P1 and P2 so that the circuit boards P1 and P2 are parallel to each other.

In the male connector 10, the two contact portions 22, or the first contact portion 22A and the second contact portion 22B, of the terminal 20 that are supported on the sidewalls 14 enter inside of the receiving recess portion 32 of the female connector 30. Further, the protruding portion 36 of the female connector 30 enters into the recess portion 12 of the male connector 10. The protruding portion 36 has an island shape.

Accordingly, the first contact portion 22A and the second contact portion 22B elastically contact with the first contact portion 52A and the second contact portion 53A of the two contact arms of the terminal 50, or the first contact arm 52 and the second contact arm 53, respectively. The facing region in which the connection portion 23 of the terminal 20 of the male connector 10 faces the top face of the sidewall 34 of the female connector 30 contacts or becomes near the top face. Accordingly, the connectors are completely fitted with each other to a specific depth.

Figure 6:
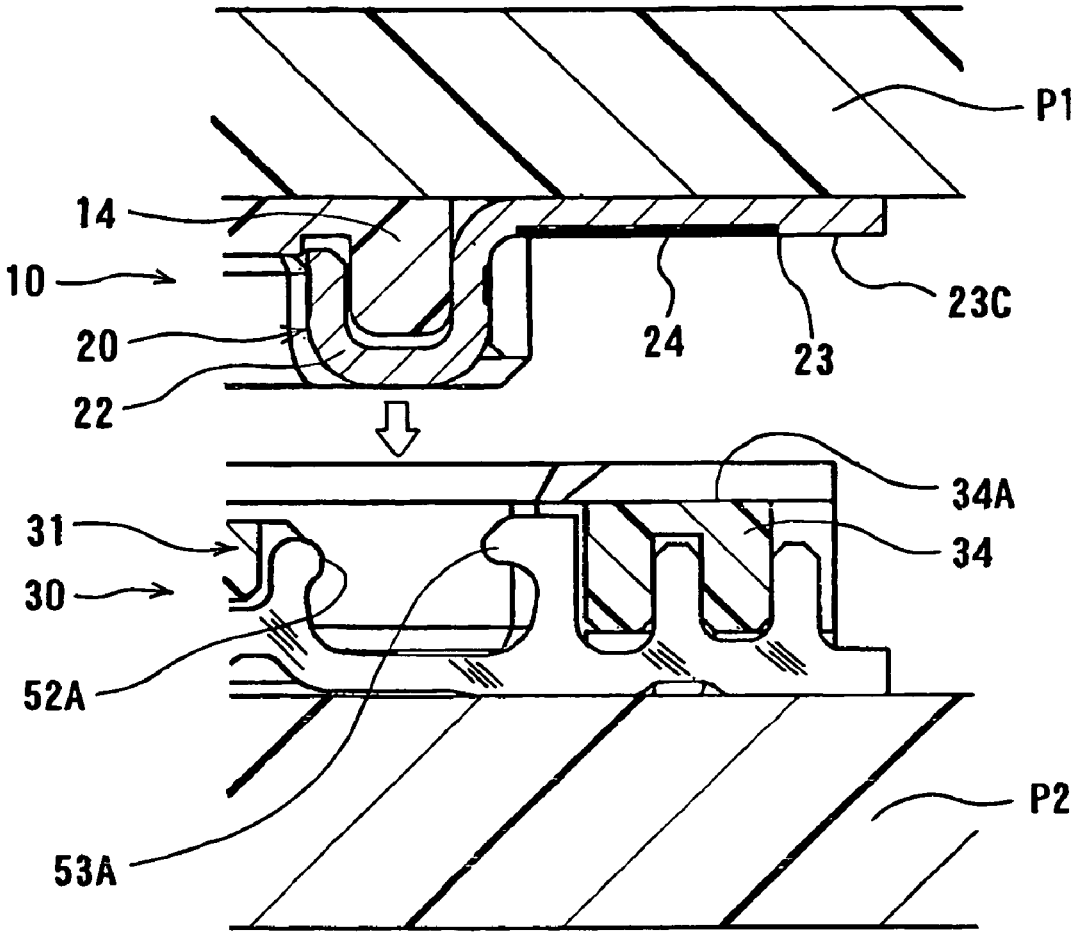
FIG. 6 is an enlarged perspective view showing another modified example of the connection portion of the male connector according to the embodiment of the present invention.

The present invention is not limited to the embodiments shown in FIGS. 1 to 5, and various changes can be made. FIG. 6 is an enlarged perspective view showing another modified example of the connection portion 23 of the male connector 10 according to the embodiment of the present invention.

First, in the male connector 10, as shown in FIG. 6, it is not necessary to form a solder barrier layer in the distal area 23C when the connection portion 23 extends long in the facing region of the connection portion 23 of the terminal 20 and the distal area 23C does not face the top face 34A of the sidewall 34 of the housing 31 of the female connector 30, the mating connector.

The solder barrier layer 24 can be formed except the distal area 23C. Solder swelling occurs in the distal area 23C. Accordingly, the solder connection at the connection portion 23 becomes stronger. Further, the solder connection can be visually confirmed with ease due to the solder swelling. Accordingly, when the solder barrier layer 24 is formed except the distal area 23C, the revolving solder barrier layer 24A can be formed as in the case of FIG. 5.

Figure 7:
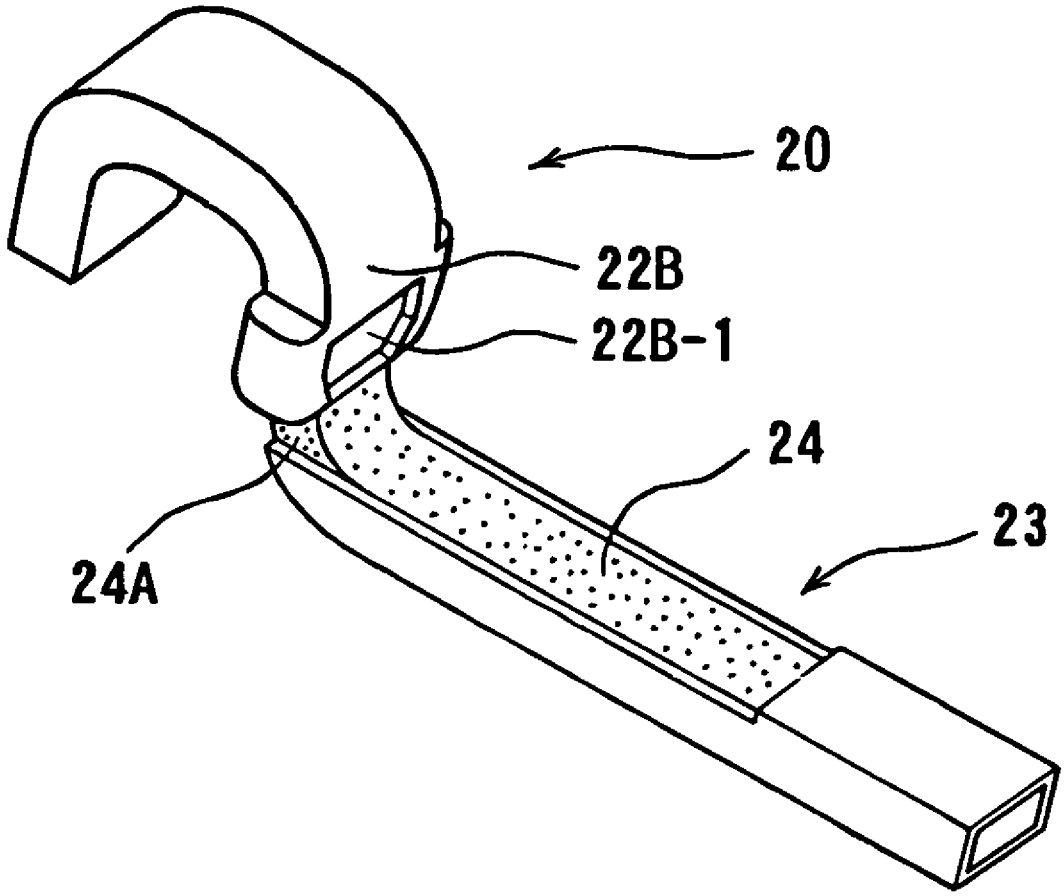
FIG. 7 is an enlarged perspective view showing a further modified example of the connection portion of the male connector according to the embodiment of the present invention.

FIG. 7 is an enlarged perspective view showing a further modified example of the connection portion 23 of the male connector 10 according to the embodiment of the present invention. It is preferred that the revolving solder barrier layer 24A be formed near a border position with the second contact portion 22B. FIG. 7 shows a case in which the solder barrier layer is not formed in the distal area 23C in the revolving solder barrier layer 24A.

Figure 8:
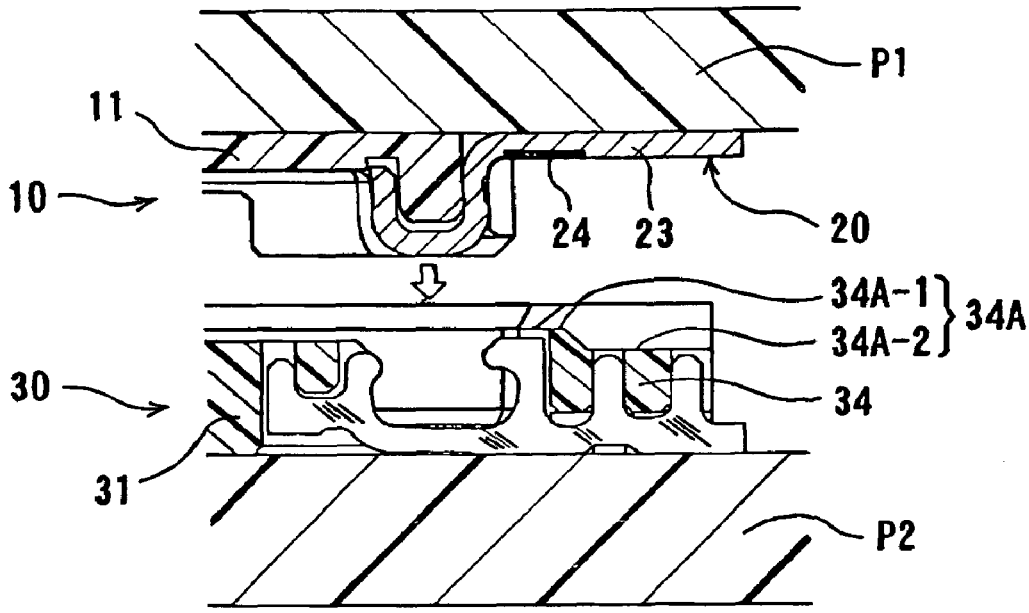
Figure 8:
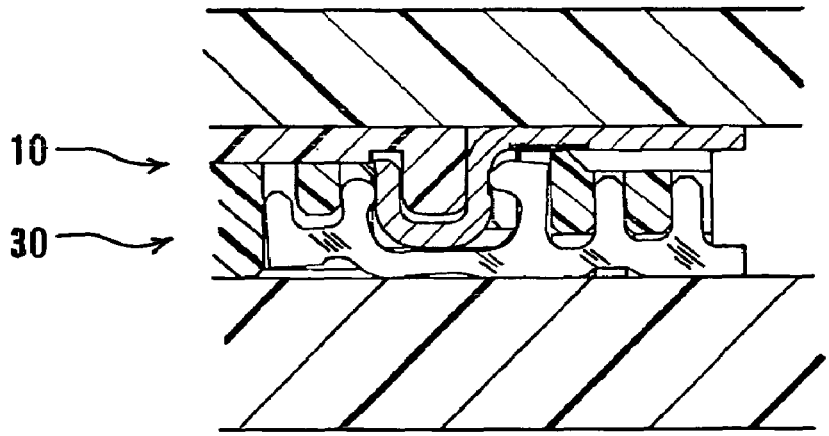

FIGS. 8(A) and 8(B) are sectional views showing the male connector 10 and the female connector 30 according to another embodiment of the present invention. More specifically, FIG. 8(A) is a sectional view showing the male connector 10 and the female connector 30 before the male connector 10 is fitted into the female connector 30, and FIG. 8(B) is a sectional view showing the male connector 10 and the female connector 30 after the male connector 10 is fitted into the female connector 20.

In the female connector 30, when the solder barrier layer 24 is formed only in a portion of the base portion side of the connection portion 23 of the terminal 20 of the male connector 10 in the extending direction of the connection portion 23, as shown in FIG. 8(A), the top face 34A of the sidewall 34 of the housing 31 is formed to be in a step shape and a residual portion 34A-2 is recessed with respect to an adjacent portion 34A-1. A portion that corresponds to the solder barrier layer 24 is the adjacent portion 34A-1 with respect to the solder barrier layer 24. An area that corresponds to the adjacent portion 34A-1 with respect to the male connector 10 is the nearest facing region.

Accordingly, the connection portion 23 of the terminal 20 of the male connector 10 can broaden the distal area in which the solder barrier layer is not formed. As a result, the solder swelling improves the connection strength. Further, solder can be confirmed visually with ease. Further, the residual portion 34A-2 that corresponds to the distal area is recessed from the adjacent portion 34A-1 in the sidewall 34 of the housing 31 of the female connector 30. Accordingly, even if there is solder swelling, as shown in FIG. 8(B), the solder swelling is not adjacent to the top face 34A of the sidewall 34 upon fitting of the connectors. That is, the fitting of the connectors is not inhibited.

The disclosure of Japanese Patent Application No. 2007-150054, filed on Jun. 6, 2007 is incorporated in the application by reference.

While the invention has been explained with reference to the specific embodiments of the invention, the explanation is illustrative and the invention is limited only by the appended claims.

What is claimed is:

1. A male connector to be attached to a circuit board for fitting into a female connector in a fitting direction perpendicular to the circuit board, comprising:

a first housing; and a terminal extending outside the housing in parallel to the circuit board, said terminal including a connection portion to be connected with a circuit portion of the circuit board with solder, said connection portion including a facing region facing a top face of a peripheral wall of a second housing of the female connector in the fitting direction when the male connector is fitted into the female connector, said facing region including a solder barrier layer at least in a nearest facing region thereof situated to be closest to the top face in the fitting direction, said solder barrier layer having poor solderability as compared to a remaining portion of the facing region.

2. The male connector according to claim 1, wherein said solder barrier layer is formed in a band shape extending from a portion of the terminal on a base portion side thereof toward a peripheral surface thereof in an extending direction of the connection portion.

3. The male connector according to claim 2, wherein said nearest facing region is formed on the base portion side in the extending direction of the connection portion.

4. The male connector according to claim 1, wherein said solder barrier layer is plated with nickel.

5. The male connector according to claim 1, wherein said solder barrier layer is exposed from the first housing.

6. A connector assembly, comprising:

a female connector to be attached to a first circuit board, said female connector including a first terminal and a first housing having a peripheral wall; and a male connector to be attached to a second circuit board and fitted into the female connector in a fitting direction, wherein said male connector includes a second housing and a second terminal extending outside the second housing in parallel to the second circuit board, said second terminal including a connection portion to be connected with a circuit portion of the second circuit board with solder, said connection portion including a facing region facing a top face of the peripheral wall in the fitting direction when the male connector is fitted into the female connector, said facing region including a solder barrier layer at least in a nearest facing region thereof situated to be closest to the top face in the fitting direction, said solder barrier layer having poor solderability as compared to a remaining portion of the facing region.

7. The connector assembly according to claim 6, wherein said top face includes a portion corresponding to the facing region, said portion including an adjacent portion corresponding to the nearest facing region and a residual portion, said residual portion being recessed from the adjacent portion in the fitting direction.

8. The connector assembly according to claim 6, wherein said first terminal is formed of a metal sheet maintaining a flat plate surface thereof, said second terminal being formed of a metal band body bending in a plate thickness direction thereof.

9. The male connector according to claim 6, wherein said solder barrier layer is plated with nickel.

10. The male connector according to claim 6, wherein said solder barrier layer is exposed from the first housing.

11. The male connector according to claim 6, wherein said facing region is arranged to face a top face of the first terminal in the fitting direction when the male connector is fitted into the female connector.

* * * * *